United States Patent [19]

Ehrig et al.

[11] Patent Number: 4,691,515

[45] Date of Patent: Sep. 8, 1987

[54] HOT GAS ENGINE OPERATING IN ACCORDANCE WITH THE STIRLING PRINCIPLE

[75] Inventors: Dietrich Ehrig, Grasberg; Hans-Juergen Jacobs, Stuhr, both of Fed. Rep. of Germany

[73] Assignee: ERNO Raumfahrttechnik GmbH, Bremen, Fed. Rep. of Germany

[21] Appl. No.: 709,509

[22] Filed: Mar. 8, 1985

[30] Foreign Application Priority Data

Mar. 8, 1984 [DE] Fed. Rep. of Germany ..... 3408480

[51] Int. Cl.[4] ..... F02G 1/04

[52] U.S. Cl. ..... 60/526; 60/525

[58] Field of Search ..... 60/517, 518, 519, 525, 60/526; 62/6

[56] References Cited

U.S. PATENT DOCUMENTS 1,675,829 7/1928 Smith ..... 60/526 X
3,482,457 12/1969 Wallis ..... 60/518 X
3,994,136 11/1976 Polster ..... 60/525 X

FOREIGN PATENT DOCUMENTS 1601472 6/1970 Fed. Rep. of Germany ..... 60/517

*Primary Examiner*—Stephen F. Husar
*Attorney, Agent, or Firm*—Ralf H. Siegemund

[57] ABSTRACT

A hot gas engine operating with a Stirling cycle includes a cylindrical space filled with a process gas and containing one or two working pistons and one or two displacement pistons moveable longitudinally in relation to each other. The displacement piston or pistons are integrated with the respective regenerator. The working and displacement piston or pistons are associated with transmission gears constructed as thrust crank transmissions so as to convert rotary motion into longitudinal piston displacement motion and vice-versa.

10 Claims, 10 Drawing Figures

HOT GAS ENGINE OPERATING IN ACCORDANCE WITH THE STIRLING PRINCIPLE

BACKGROUND OF THE INVENTION

The present invention relates to a hot gas engine operating in accordance with a Sterling engine, wherein a cylindrical space is provided, filled with process gas and containing additionally a working piston and a displacement piston which are longitudinally moveable therein and towards and away from each other; furthermore a regenerator is associated with the cylindrical space, and the engine moreover includes a transmission unit positively connected to the working piston.

Engines working in accordance with a Stirling cyclic process are known in the art. Their working principle is based, just as is the case of the so-called Otto and Diesel engines on the principle that a process gas is compressed at low temperatures and subsequently expands at high temperature. Contrary however to the Otto and Diesel engines, the Stirling engine does not operate with a process gas which is heated through internal combustion, but the heat is applied to the process gas from the outside, so that essentially this type of engine operates by converting temperature differences into mechanical work.

A Stirling engine of the type mentioned above is for example known in the literature by W. Klide in "ENERGIE-UNWANDLUNG IN KRAFT UND ARBEITSMASCHINEN (Energie Conversion into Force and Working Machines, 1982, pages 178 through 181). This known Stirling motor or engine includes a regenerator, arranged outside of the cylindrical space for the pistons but being connected thereto through channels, particularly to the respective hot and cold zones of the cylinder space. The known literature citation moreover discloses Stirling engines in a modern version to be conceived basically as single cylinder engine. Frequently they are equipped with Rhombic transmissions which control the kinematics that is required for realizing a cyclic process so as to obtain the requisite movements of working and displacement pistons.

DESCRIPTION OF THE INVENTION

It is an object of the present invention to provide a new and improved hot gas engine of the Stirling engine type wherein a working piston and a displacement piston are longitudinally moveable in opposition to each other within a cylinder filled with process gas and which engine includes a regenerator associated with the main cylinder there being further more a transmission unit, positively connected to the working piston.

It is a feature of the present invention to imporve Stirling engines as stated in the object above so as to exhibit a very simple construction while permitting a pronounced increase in power output.

In accordance with the preferred embodiment of the present invention, the object is attained by constructing the displacement piston as the regenerator and by providing the transmission unit as a transmission gear separately for each of the pistons and being constructed in each instance in accordance as a thrust crank transmission gear. The gears are preferably also arranged within the space filled with process gas. It is particularly suggested to provide the displacement piston in its interior as a heat store.

The linkage points of the piston rods to the gears are selected so that the two pistons run with a phase shift of about 45 degrees (the displacement piston leading relative to the working piston). In the case of a multiple cylinder and piston unit respective two working pistons and two displacement pistons may be combined in a common housing in accordance with a so-called boxer engine. In the latter case, the cylindrical spaces as well as the engine space in between should constitute an encapsuled spacial unit. It is further more suggested to provide the piston rod of the working piston as a hollow rod, which in its central portion has an oblong slot like aperture in which a laterally extending, pin-shaped projection of the piston rod for displacement piston is longitudinally moveably disposed. The latter piston is of course effectively connected to the gear associated with the displacement piston.

A hot gas engine constructed in accordance with the principle of the present invention offers the advantage of only very small mechanical losses. Concurrently it is possible to increase the internal pressure of the process gas so as to shift the cyclic process towards a higher pressure region without additional requirement and energy, which of course means that the efficiency is increased accordingly. Since the transmission gear is situated within the process chamber generally, the sealing of that chamber is facilitated because one needs only a slide ring seal around the output shaft of the engine.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Figure 1:
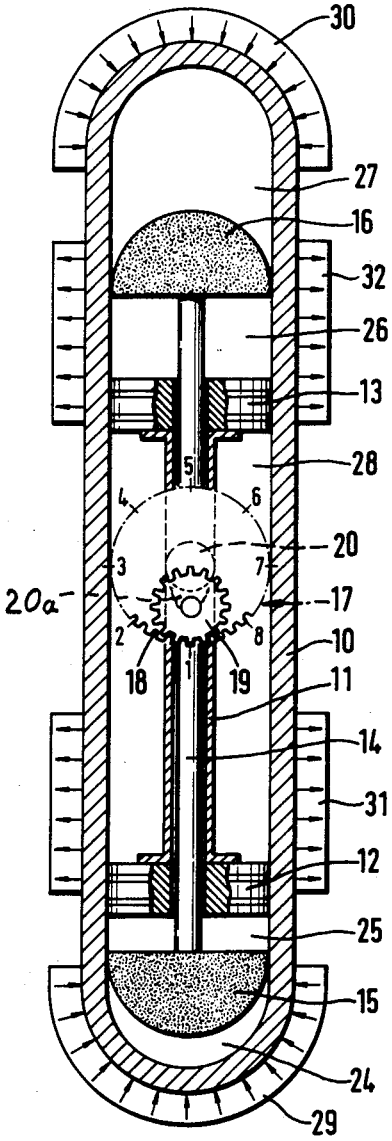
FIG. 1 is a longitudinal section view through a hot gas engine constructed in accordance with the preferred embodiment of the present invention, for practicing the best mode thereof.
Figure 3:
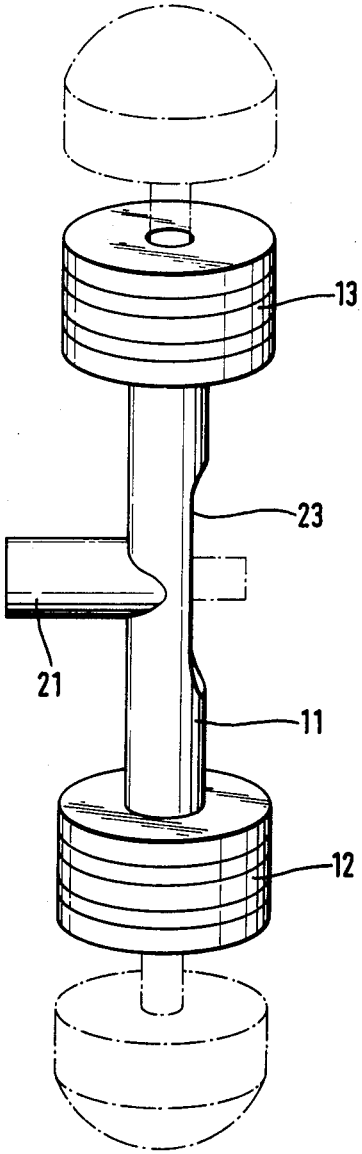
Figure 4:
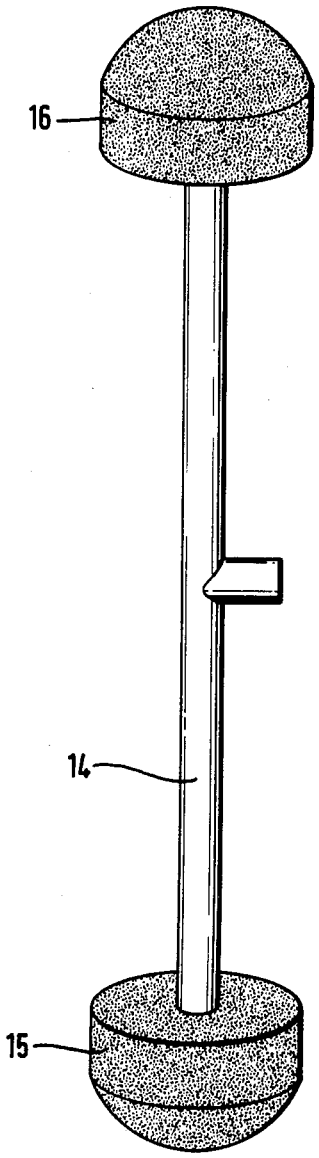
Figure 5:
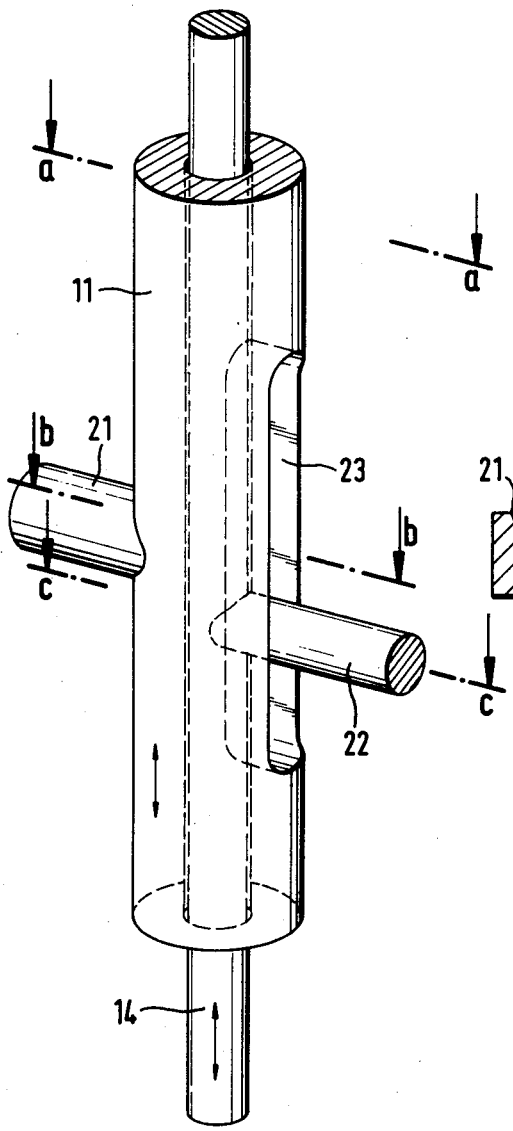
Figure 5A:
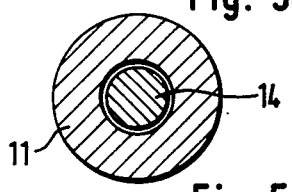
Figure 5B:
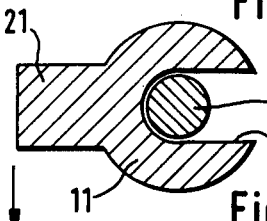
Figure 5C:
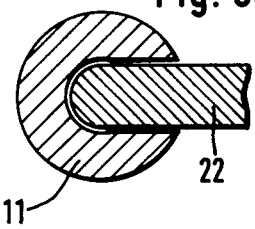

FIG. *2a*, *2b*, and *2c*, are diagrams for illustrating the operation of the engine shown in FIG. 1;

FIG. 3, illustrates somewhat perspectively details of the working piston;

FIG. 4 is analoguously to FIG. 3 a more detailed illustration of the displacement piston;

FIG. 5 is a perspective view of the piston rod construction in the preferred embodiment and FIGS. *5a*, *5b*, and *5c*, are respectively section view as indicated by lines aa, bb, and cc in FIG. 5.

Proceeding now to the detailed description of the drawings, FIG. 1 illustrates the new engine which is basically an engine unit operating with a Stirling type cyclic process. The drawing shows in particular a twin engine, or dual engine unit, structurally combined in a single unit and in a boxer engine kind configuration. Thus, there is a common cylindrical case 10 in which are movably disposed two working pistons 12 and 13, being respectively disposed at opposite ends of a common piston rod 11. The piston rod 11, as well as the working piston 12 and 13 themselves are provided wtih central traversing bores illustrated in greater detail in FIGS. 3, 4, and 5. These bores receive a second piston rod 14, which may move longitudinally in the common bore of the elements 11, 12 and 13. The second piston rod 14 therefore is longer than the piston rod 11 and projects beyond the working pistons 12 and 13. Respective displacement pistons 15 and 16 are disposed on and carried by the ends of the piston rod 11.

In accordance with a specific feature of the invention the requisite regenerators are not provided external to the engine proper, but the displacement pistons 15 and 16 are constructed as regenerators. This way one does not need any additional channels for feeding process gas into the cylindrical space in which the various pistons move. The displacement-regenerator pistons are internally constructed particularly as heat store.

The interior of the casing and cylindrical space 10 contains additionally two similarly constructed transmission gears 17 of the gear wheel type. Only one is shown in FIG. 1; the 2nd one is not visible in FIG. 1 due to the elevational view of the interior of the chamber 10; this second gear is situated behind the piston rods 11 and 14. The two transmission gears are drivingly interconnected through suitable synchronization structures, not shown, but in a manner known per se.

Each of the transmission gears 17 is comprised of a gear with internal teeth arrangement 18 and being affixed to and secured in the casing 10.

An externally toothed gear 19 meshes the gear 18 and is linked to the central shaft 20 via a spacer or crank shaft arm 20*a*. The diameters of the gears 18 and 19 are chosen to have the ratio of 2 to 1, so that for one revolution of a gear 19 inside gear 18, any point along the periphery of the gear 19 will in fact undergo a linear back and forth movement along a diameter line of the larger wheel 18. One particular point (e.g. 1) will undergo a motion parallel to the axes of rods 11 and 14 which is equivilent to the operation of a thrust type crank transmission. A pin 21 is linked to that point 1 of gear 19 to therewith link the piston rod 11 for the working pistons 12 and 13, through pin 21 to the gear 19. This then is the mode of operation by means of which the rotating motion of the gear 19 is transformed into a linear motion, i.e. a back and forth motion of the piston rod 11.

Of course this aspect is used kinematically only, in reality the transmission of force, power and motion occurs in the reverse direction, when the engine operates as a motor. As will be shown below, the flow of power and energy can be reversed.

The second gear transmission, behind the one illustrated in FIG. 1, has its rotating, small, externally toothed gear connected to a pin 22, which in turn is linked to the piston rod 14 for the two regenerators and displacement pistons 15 and 16. The pin 22 in this case traverses an oblong aperature 23 of the piston rod 11 and thereby becomes independently moveable as far as the rod 11 is concerned so as to move the piston rod 14 in accordance with the gearing that is coupled to the regenerator and displacement pistons 15 and 16.

Accordingly the two piston rods 11 and 14 are relatively moveable in relation to each other in dependance upon the respective transmission gearing whose phase of rotation will determine the relative motions of these pistons rods and the respective pistons in relation to each other. In this particular preferred embodiment shown in the drawings the pin 22 is positioned in relation to the pin 21 so that the piston rod 14 moves in relation to the piston rod 11 at a phase shift of $\pi/4$ which is 45 degress whereby as far as the full cycle is concerned the rod 14 leads the rod 11.

The interior of the case 10 can be deemed partitioned into individual spaces or chambers 24, 25, and 26 and 27 and the general space or drive chamber 28, which contains the two transmission gears. Basically all these chambers are filled with pressurized process gas. This gas receives thermal energy through the two heating areas 29 and 30 provided at the end portions of the chamber 10.

On the other hand the zones or areas 31 and 32 are established for cooling the respective adjacent portions of the chamber 10. The zones of cooling and heating are of course stationary as far as the case 10 is concerned, whereas the spaces and chambers 24 and 27 vary in size, while the chambers 25 and 26 vary in size as well as in relative disposition within the casing 10. Generally speaking however, cooling and heating zones are kept apart and separated from each other by operation of the respective regenerator and discharge pistons. Here it is significant that each of these regenerator pistons 15 and 16, are also constructed as a heat store so as to be able to store some of the heat and thermal energy transmitted to it, when in respective proximity to the heating zone, so as to be able to yield this heat to the process gas in the beginning of a working stroke of the respective working piston.

After having described in detail the construction of the engine involved, reference is now made to the operation thereof. The various phases of movements of working and regenerator pistons in the cylinder and as it affects the various cylinder spaces is described now with specific reference here to the construction of a hot gas engine.

Figure 2A:
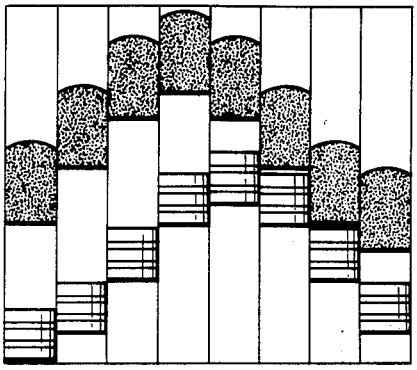
Figure 2B:
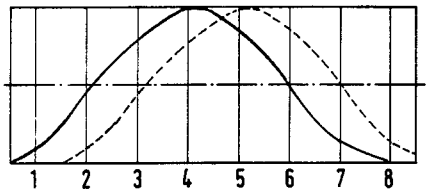
Figure 2C:
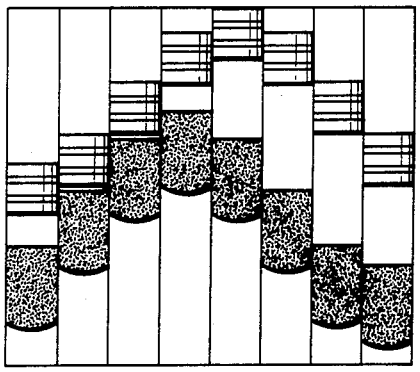

FIG. 2*a* in particular illustrates the various phases of movement of the pistons 13 and 16; FIG. 2*c* illustrates the various phases of movement of the pistons 12 and 15, while FIG. 2*b* represents in fact a cycle of movement of the two pins 21 and 22. In order to facilitate the description the three FIG. 2*a*, 2*b* and 2*c* are drawn in vertical alignment that is to say, the respective horizontal dimension or axis of these diagrams refers to the same instants and periods of time.

The FIG. 2*a*, 2*b* and 2*c* reveal that position 1 as indicated in FIG. 2*b* corresponds to the particular instance of the pistons shown in FIG. 1 which, as far as this illustration is concerned, is of course an arbitrary disposition. Beginning approx. from position 3, as per FIG. 2*a*, there begins the compression phase and from about position 5 one obtains the expansion phase, i.e. the working stroke.

FIG. 2*c* illustrates the operating positions of the second cylinders which are of course at a different phase and the two phases are shifted such that an optimum is obtained concerning a quiescence of the engine and uniformity in power control transmission and conduction.

The kinematics in the two cylinders is selected such that the compression of the process is carried out while heat is extracted therefrom, while the expansion phase is synchronized with the supply of thermal energy from the external sources 29 or 30. In accordance with the principle underlying the operation of a Stirling engine one obtains in this manner the desired drive power. For sealing the chamber 10 so as to contain and retain the process gas, sliding ring seals are provided on the shaft 20 by means of which power is extracted from the engine. This means that the particular device illustrated requires only sealing of a single rotating component. This permits filling of the cylinder spaces with a highly compressable process gas to thereby increase the efficiency of the machine and to shift the cyclic process to a higher energy level without in fact expanding additional energy but merely making use of a higher efficiency if higher pressures are operated with.

It is of course possible in principle that the inventive hot gas engine is comprised of a cylinder having a single working piston and a single regenerator and displacement piston. On the other hand a multiple of such units can in fact be combined in larger units all acting on a common shaft. Such multiple units find utility for example in heat pumps or even in conjunction with Otto or Diesel engines for driving auxiliary aggregates such as emergency light machines, ventilators or the like. Essential here is that the otherwise wasted heat of Otto and Diesel engines can be used immediately and directly for obtaining mechanical energy.

It should be observed that the inventive Stirling engine runs very quietly and does not load the ecology. In fact it is a machine which can use any kind of heat source including otherwise wasted thermal energy, and it can for example be used to run on solar and atomic energy for example energy that is not useable otherwise.

Another advantage of the invention is to be seen in the fact that contrary to the Otto and Diesel engine, the operational principle of the process involved in a Stirling engine is reverseable. This means that the particular device can be run in a manner that the shaft 20 is not a drive shaft but a driven shaft, i.e. the pistons will now be driven with externally developed mechanical energy. Upon running the engine in this fashion one produces in the cylinder a hot and cold side on end. Depending now upon which of these ends, cold or hot, are put into direct heat exchange relationship with a medium having ambient temperature one produces either a cooling machine or heat pump. The boxer type engine as illustrated makes it possible to provide one side as a heat pump and the other one as a cooling machine.

The device can be operated in fully encapsulated fashion, so that one does not even have the problem of sealing shafts. In other words the shaft 20 can be driven by a motor which in effect integrally connected to the casing 10 as far as its housing is concerned, forming therewith a complete unit, so that no moving part has to penetrate any sealed space.

An advantageous utilization for the inventive machine can be found for ex. in the tropics which may be of interest as far as fully encapsulated Stirling type cooling machines are concerned and which depending upon the intensity of solar radiation provides a certain amount of cooling. The process runs parallel to the cooling power requirement in case of solar radiation input.

The invention is not limited to the embodiments described above, but all changes and modifications thereof, not constituting departures from the spirit and scope of the invention, are intended to be included.

What is claimed is:

1. Hot gas engine operating in accordance with a Stirling engine type principle comprising, a cylinder having spacially separated external means in heat conductive relationship with the interior of the cylinder and establishing separated hot and cold zones therein;

a piston operating as displacement as well as regenerator piston moveable in said cylinder;

a working piston likewise moveable in said cylinder and also relative to the regenerator piston wherein said displacement piston is mounted on a piston rod traversing said working piston, said working piston being mounted on a hollow piston rod being traversed by the piston rod mounted to said displacement piston; and transmission gear means constructed to operate in a crank shaft manner by converting a rotary motion into linear motions for the two pistons and being accordingly coupled to both said pistons and having a common rotary input-output.

2. Engine as in claim 1, wherein gears of the gear means are contained in an interior space of the cylinder being filled with process gas.

3. Hot gas engine as in claim 1, wherein said transmission gear means includes a first transmission gear coupled to the working piston and a second transmission gear coupled to the displacement and regenerator piston, said two transmission gears are interconnected to provide for a phase shift in piston movements of a difference of about 45 degrees.

4. Hot gas engine as in claim 1, wherein said hollow piston rod has an oblong slot traversed by a pin, said pin being connected to said transmission gear means.

5. Hot gas engine as in claim 4, said transmission gear means including two gear systems operating in different phases of rotation, said pin being connected to one of said gear system, the other one of the gear systems being connected to the hollow piston rod.

6. Hot gas engine in accordance with claim 1, wherein said displacement piston is constructed as a heat store.

7. Hot gas engine operating in accordance with a Stirling engine principle, comprising:

a cylindrical case;

external means in heat conductive relation with the case for establishing two hot zones and two cold zones inside the case, all of the zones being separated from each other;

a first pair of displacement pistons, moveable in said cylinder case, and respectively operating in one of the hot zones and one of the cold zones;

a second pair of working pistons movable also in the cylinder case and operating respectively in the other ones of the zones; and gear means in said casing and including a first transmission gear coupled to the two working pistons and a second transmission gear coupled to the two displacement and regenerator pistons for converting reciprocating motions of said pistons into rotary motion or vice-versa.

8. Hot gas engine operating in accordance with a Stirling engine principle, comprising a cylindrical case;

external means in heat conductive relation with the cases for establishing two hot zones and two cold zones inside the case, both zones being separated from each other;

a first pair of displacement pistons, moveable in said cylinder case, being constructed as regenerators, and operating in one of the hot zones and one of the cold zones;

a second pair of working pistons, moveable also in said cylinder case and operating in the other ones of said zones; said displacement pistons are mounted on a piston rod traversing said working pistons, said working pistons being mounted on a hollow piston rod being traversed by the piston rod mounted to said displacement piston; and gear means in said casing coupled to said pistons in a particular phase relationship for converting reciprocating motions of all said pistons into a combined rotary motion or vice-versa.

9. Hot gas engine as in claim 8, wherein said hollow piston rod has an oblong shot traversed by a pin, said pin being connected to said transmission gear.

10. Hot gas engine as in claim 9, said transmission gear having two phase shifted gear systems, said pin being connected to one of said gear system, the other one of the gear systems being connected to the hollow piston rod.

* * * * *